US007223916B2

(12) United States Patent
Kawamura

(10) Patent No.: US 7,223,916 B2
(45) Date of Patent: May 29, 2007

(54) CONNECTOR FOR SHIELDED ELECTRIC WIRE AND METHOD FOR CONNECTING THE SAME WITH SHIELDED ELECTRIC WIRE

(75) Inventor: Tomoki Kawamura, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/099,550

(22) Filed: Apr. 6, 2005
(Under 37 CFR 1.47)

(65) Prior Publication Data

US 2006/0086526 A1 Apr. 27, 2006

(30) Foreign Application Priority Data

Apr. 7, 2004 (JP) ..... 2004-113165

(51) Int. Cl.
*H01R 4/18* (2006.01)

(52) U.S. Cl. ..... 174/84 C

(58) Field of Classification Search ..... 174/84 C; 439/877
See application file for complete search history.

(56) References Cited

U.S. PATENT DOCUMENTS 4,923,416 A * 5/1990 Zinn ..... 439/877

FOREIGN PATENT DOCUMENTS

JP A 2003-264043 9/2003
JP 2004-55426 * 2/2004

* cited by examiner

*Primary Examiner*—Chau N. Nguyen
(74) *Attorney, Agent, or Firm*—Oliff & Berridge, PLC

(57) ABSTRACT

A connector for a shielded electric wire includes an inner conductor connectable to one lead wire of an electronic element; a dielectric having an accommodation hole; an outer conductor having an inner hole; and a shielded electric wire having a shielding member and a core wire connectable to the other lead of the electronic element. The accommodation hole of the dielectric holds the inner conductor connected to one lead wire of the electronic element. The core wire of the shielded electric wire is connected to the other lead wire of the electronic element after the dielectric is inserted and held in the inner hole of the outer conductor. The shielding member of the shielded electric wire is connected to the outer conductor.

6 Claims, 6 Drawing Sheets

CONNECTOR FOR SHIELDED ELECTRIC WIRE AND METHOD FOR CONNECTING THE SAME WITH SHIELDED ELECTRIC WIRE

BACKGROUND OF THE INVENTION

1. Field of the Invention

The present invention relates to a connector for a shielded electric wire, including an electronic element, which is connected to a terminal of the shielded electric wire, and a method for connecting with the shielded electric wire.

2. Description of the Related Art

Such a connector was available as a prior art concerning a connector for connection to a shielded electric wire, in which an inner conductor is first pressure-fitted to the core wire of a shielded electric wire, and a chip-type capacitor is soldered to the inner conductor for electric connection, and further the inner conductor is accommodated in a dielectric held in an outer conductor (For example, refer to JP-A-2003-264043 (8th to 9th columns, and FIG. 1)). According to the prior art, it was necessary that work from connection of the core wire of a shielded electric wire with the inner conductor to accommodation thereof in the outer conductor was carried out at one time, and the work efficiency was not satisfactory. In addition, it was necessary that respective components were separately conveyed to a place where connection work is carried out, wherein conveying efficiency was not satisfactory. Still further, a great space was required as a custody place of the respective components.

SUMMARY OF THE INVENTION

The present invention has been developed on the basis of the above-described situations, and it is therefore an object of the invention to provide a connector for a shielded electric wire and method for connecting the same with shielded electric wire, which enable an efficient connection to a shielded electric wire.

According to one aspect of the invention, there is provided with a connector for a shielded electric wire includes: an inner conductor connectable to one lead wire of an electronic element; a dielectric having an accommodation hole; an outer conductor having an inner hole; and a shielded electric wire having a shielding member and a core wire connectable to the other lead of the electronic element. The accommodation hole of the dielectric holds the inner conductor connected to one lead wire of the electronic element. The core wire of the shielded electric wire is connected to the other lead wire of the electronic element after the dielectric is inserted and held in the inner hole of the outer conductor. The shielding member of the shielded electric wire is connected to the outer conductor.

By thus configuration, an inner conductor connected to one lead wire of an electronic element is inserted and held in an accommodation hole of a dielectric, the dielectric is supplied in a state where the dielectric is inserted and held in an inner hole of an outer conductor, thereafter, the core wire of a shielded electric wire is connected to the other lead wire of the electronic element, and a shielding member of the shielded electric wire is connected to the outer conductor. Therefore, since the connector for shielded electric wire can be made into an assembly in a state where only connection work of connecting the connector with a shielded electric wire is left over, the connection efficiency is satisfactory and conveyance efficiency of components can be improved.

According to another aspect of the invention, the electronic element is a capacitor of which electrostatic capacitance is adjustable By thus configuration, the electronic element is a capacitor and the electrostatic capacitance thereof is made adjustable. Therefore, the connector enables various uses.

According to another aspect of the invention, the electronic element is a diode which rectifiably transmits a signal.

By thus configuration, the electronic element is a diode and a signal transmitted thereby is made rectifiable. Therefore, the connector enables further various uses.

According to another aspect of the invention, the one lead wire of the electronic element is connected by pressure-fitting the inner conductor.

By thus configuration, one lead wire of the electronic element is connected by pressure-fitting the inner conductor. Therefore, it is possible to firmly connect the inner conductor with an electronic element by a simple method.

According to another aspect of the invention, the inner conductor and the one lead wire of the electronic element are connected to each other by welding.

By thus configuration, the inner conductor and one lead wire of the electronic element are connected to each other by welding. Therefore, it is possible to further firmly connect the inner conductor with an electronic element in comparison with soldering.

According to another aspect of the invention, there is provided with a method of connecting a connector with a shielded electric wire; inserting an inner conductor connected to one lead wire of an electronic element in an accommodation hole of a dielectric to be held therein; inserting the dielectric in an inner hole of an outer conductor to be held therein; and connecting a shielding member of the shielded electric wire to the outer conductor while a core wire of the shielded electric wire is connected to the other lead wire of the electronic element By thus method, a connector for shielded electric wire is formed by inserting and holding an inner conductor connected to one lead wire of an electronic element in an accommodation hole of a dielectric, and inserting and holding the dielectric in an inner hole of an outer conductor, and, after the shielded electric wire connector is supplied, the core wire of a shielded electric wire is connected to the other lead wire of the electronic element, and a shielding member of the shielded electric wire is connected to the outer conductor. Therefore, since the connector for shielded electric wire can be made into an assembly in a state where only connection work of connecting the connector with a shielded electric wire is left over, the connection efficiency is satisfactory and conveyance efficiency of components can be improved.

DESCRIPTION OF THE PREFERRED EMBODIMENTS

Figure 2A:
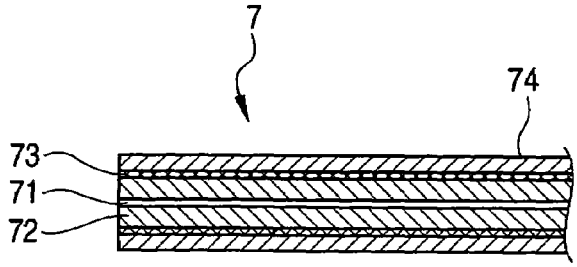
FIG. 2A is a sectional view showing a shielded electric wire placed in a process for connecting a shielded electric wire connector to a shielded electric wire.
Figure 2B:
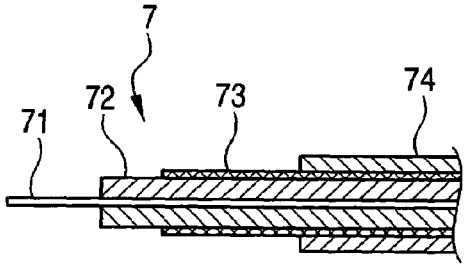
FIG. 2B is a sectional view showing a state where the end portion of the shielded electric wire is striped.
Figure 2C:
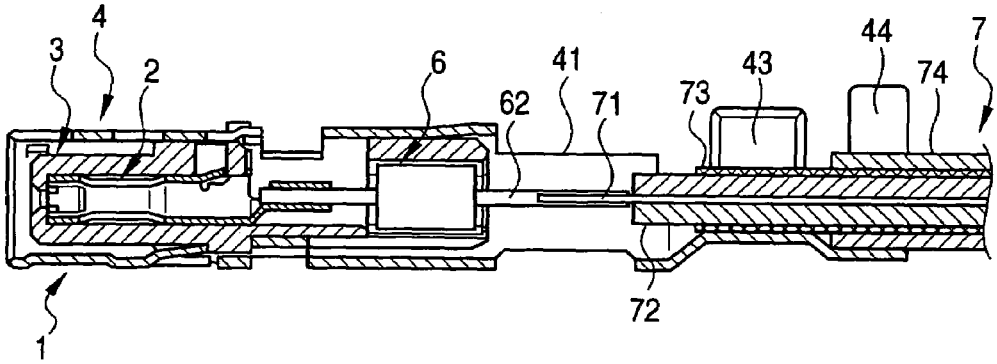
FIG. 2C is a sectional view showing a state where a shielded electric wire is disposed on an outer conductor of an assembled shielded electric wire connector.
Figure 2D:
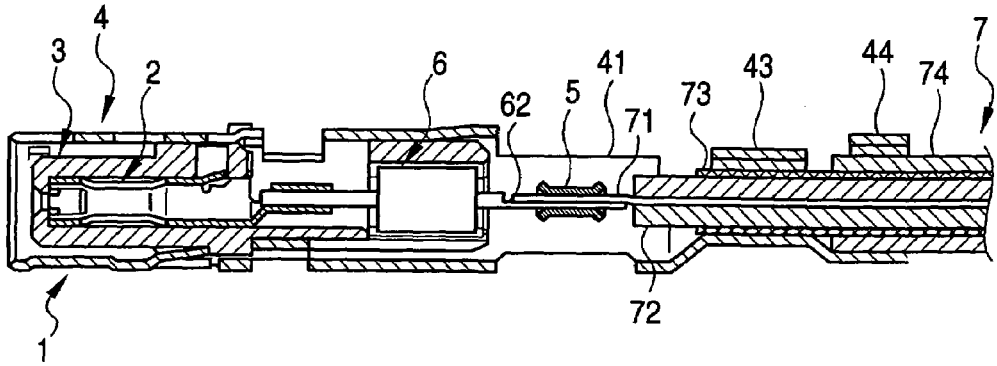
FIG. 2D is a sectional view showing a state where the lead wires of a capacitor are connected to the core wire of the shielded electric wire.
Figure 3:
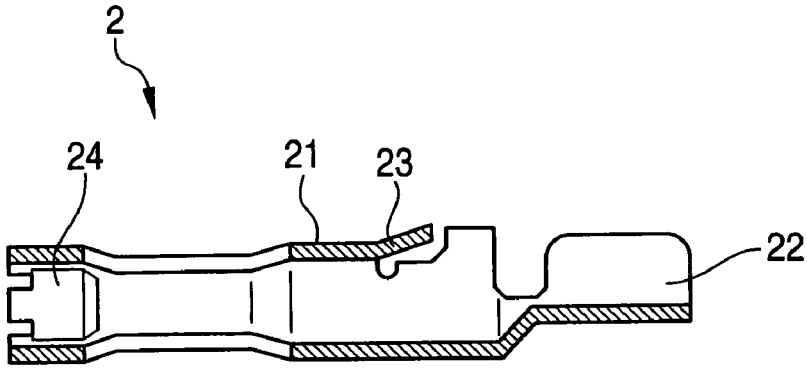
FIG. 3 is a sectional view of the inner conductor shown in FIG. 1.
Figure 4:
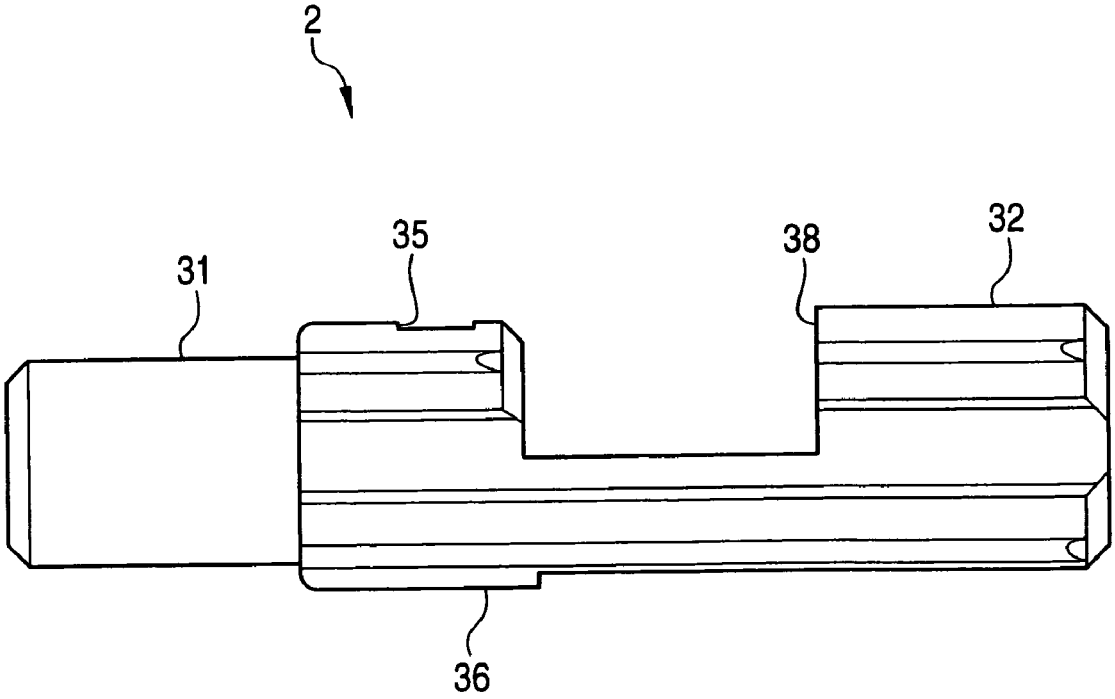
FIG. 4 is a side elevational view of the housing shown in FIG. 1.
Figure 5:
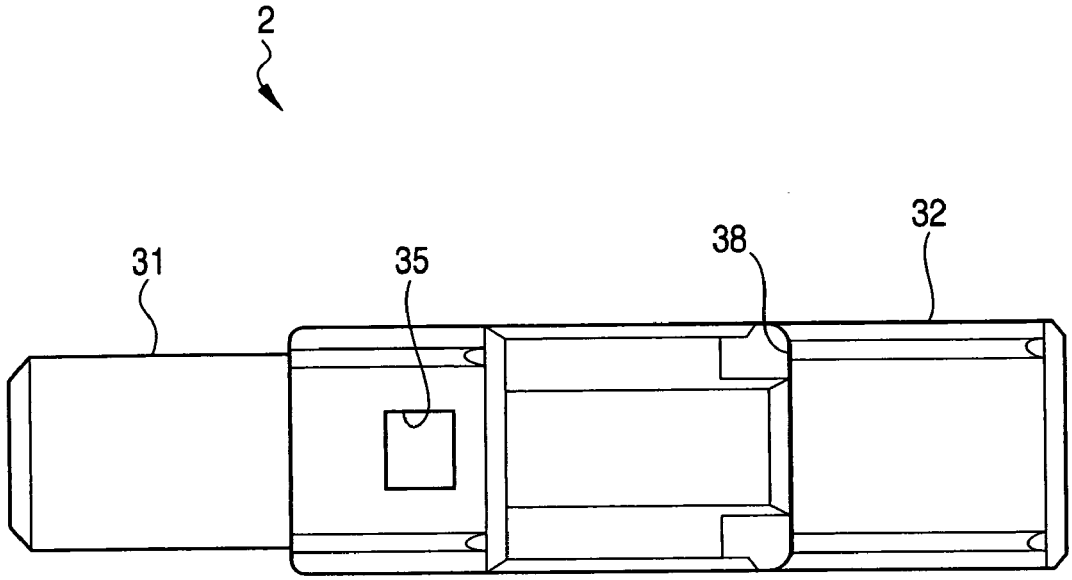
FIG. 5 is a top view of the housing shown in FIG. 1.
Figure 6:
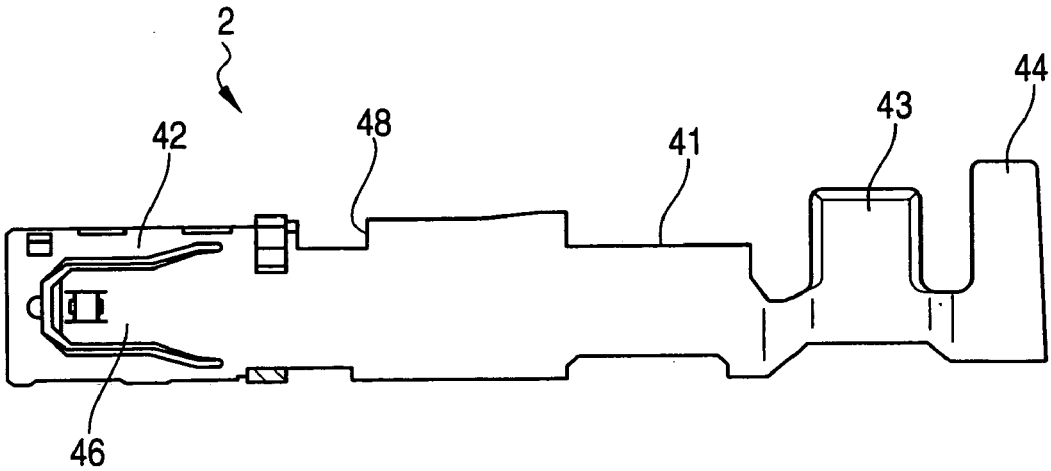
FIG. 6 is a side elevational view of the outer conductor shown in FIG. 1.

A description is given of one embodiment of the invention with reference to FIG. 1 through FIG. 9. In the description, it is assumed that the left side in FIG. 1 is regarded as forward, upward is regarded as upward, and the assumption is applied to respective components. As shown in FIG. 1 through FIG. 3, an inner conductor 2 which includes a connector 1 for a shielded electric wire is formed of a metallic plate having electric conductivity and is provided with a substrate 21. The substrate 21 is formed so as to be rectangular in its cross section by tubularly folding the metallic plate and causing the ends thereof to be faced to each other at the upper part. The substrate is provided, at the rearward part, with a pair of caulking pieces to be faced to each other, and includes a wire barrel 22 which is caulked in a state where it is pressure-fitted to a lead wire 61 of a capacitor 6 described later.

An engaging piece 23, which functions as a fall-out stopper when holding the inner conductor 2 in a housing 3 described later, protrudes upwards from the upper surface of the rear end portion of the substrate 21. In addition, a pressure catch-in portion 24 formed by causing the side face at one side of the substrate 21 to be folded in the substrate 21 is provided at the front end portion of the substrate 21 (as shown in FIG. 3). Further, a deflection piece (not illustrated) having flexibility is provided at the side face of the other side of the front-end portion so as to face the pressure catch-in portion 24. The deflection piece is engaged with the terminal of the mating connector and nips and holds the terminal of the mating connector between the deflection piece and the pressure catch-in portion 24.

The housing 3 shown in FIG. 1, FIG. 2, FIG. 4 and FIG. 5 (which corresponds to a dielectric of the embodiment of the present invention) is formed of an insulative synthetic resin material having a predetermined dielectric constant, and it presents roughly a tubular shape so that it can internally accommodates the inner conductor 2 and capacitor 6. An inner conductor accommodating portion 31 in which the inner conductor 2 is internally incorporated is formed at the forward portion of the housing 3, and an inner conductor accommodating hole 33 the section of which is rectangular (which corresponds the accommodating hole of the embodiment of the invention along with an element accommodating hole 37) is provided in the interior of the portion 31. Also, the tip end portion of the inner conductor accommodating hole 33 is closed to be bag-like, and a terminal hole 34 into which the terminal of the mating connector is inserted is pierced (as shown in FIG. 1).

Also, as described above, an engaging hole 35, with which the engaging piece 23 is engaged and becomes a fall-out stopper when the inner conductor 2 is inserted into the inner conductor accommodating hole 33, is pierced in the ceiling portion of the inner conductor accommodating hole 33 toward the exterior of the housing 3. Further, as described later, a lock protrusion portion 36, which is engaged with a locking piece 45 and is thereby held when the housing 3 is inserted into the outer conductor 4, is provided on the underside of the rear end portion of the inner conductor accommodating portion 31 so as to protrude downward. On the other hand, an element accommodating portion 32 is provided at the rearward portion of the inner conductor accommodating portion 31, and an element accommodating hole 37 the section of which is substantially round is formed in the accommodating portion 32 (as shown in FIG. 1). In addition, an opening portion 38 which is open upward is formed at a portion between the inner conductor accommodating portion 31 and the element accommodating portion 32 so as to secure good visibility of the interior.

Figure 7:
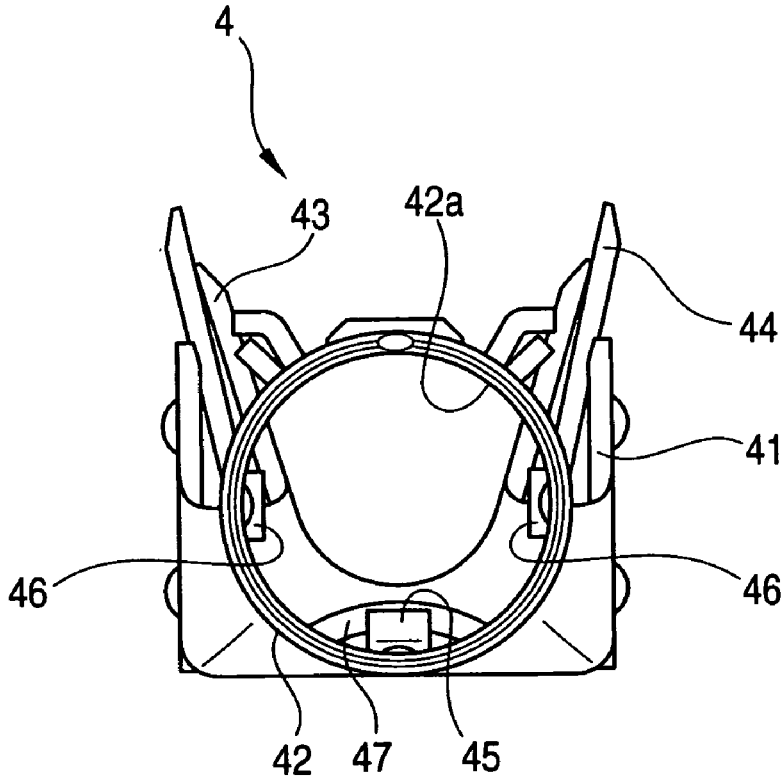
FIG. 7 is a view of the outer conductor when observed from its forward side.

An outer conductor 4 shown in FIGS. 1A to 1F, FIGS. 2A to 2E, FIG. 6 and FIG. 7 is formed of a metallic plate having electric conductivity as in the inner conductor 2, and is provided with a connection portion 41, which is formed so as to be channel-shaped in section by opening up the same upwards, at the middle portion in the lengthwise direction thereof. A shielding portion 42 formed so as to be tubular in section is provided at the forward portion of the connection portion 41, and a shield barrel 43 and a cable barrel 44 are, respectively, formed at the rearward portion thereof. The shielding portion 42 internally has an inner hole 42*a* in which the above-described housing 3 is accommodated. A one side-held locking piece 45 with which the lock protrusion portion 36 of the housing 3 is engaged extends so as to be bent upwards (as shown in FIG. 1F and FIG. 7).

In addition, a pair of holding pieces 46 having flexibility are provided at the side of the shielding portion so as to appear on the inner circumferential surface of the shielding portion 42. When the housing 3 is accommodated in the outer conductor 4, the outer circumferential surface of the housing 3 is nipped and held by the pair of holding pieces 46. Also, a stopper 47 is formed at the rearward portion of the lock piece 45 of the shielding portion 42 by lifting the underside of the lock piece 45. And, since the rear end portion of the lock piece 36 of the above-described housing 3 is brought into contact with the stopper 47, it becomes possible to position the housing 3 in the outer conductor 4 (as shown in FIG. 1E). Further, an upper portion hole 48 communicating with the opening portion 38 of the above-described housing 3 is pierced in the upper surface of the shielding portion 42. The shield barrel 43 and cable barrel 44 are formed by a pair of barrel pieces faced to each other, and, as described below, are pressure-fitted to the shielding member 73 of the shielded electric wire 7 and the outer circumferential surface of an insulative outer sheath 74 and are caulked there.

Figure 8:
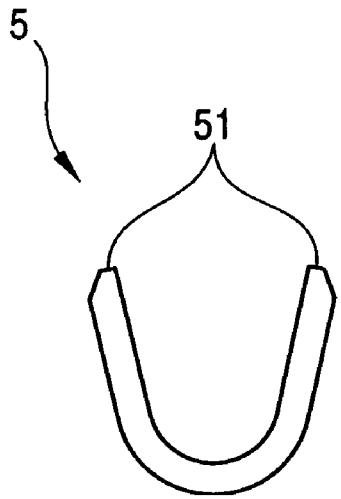
FIG. 8 is a side elevational view of the caulking member shown in FIG. 2.
Figure 9:
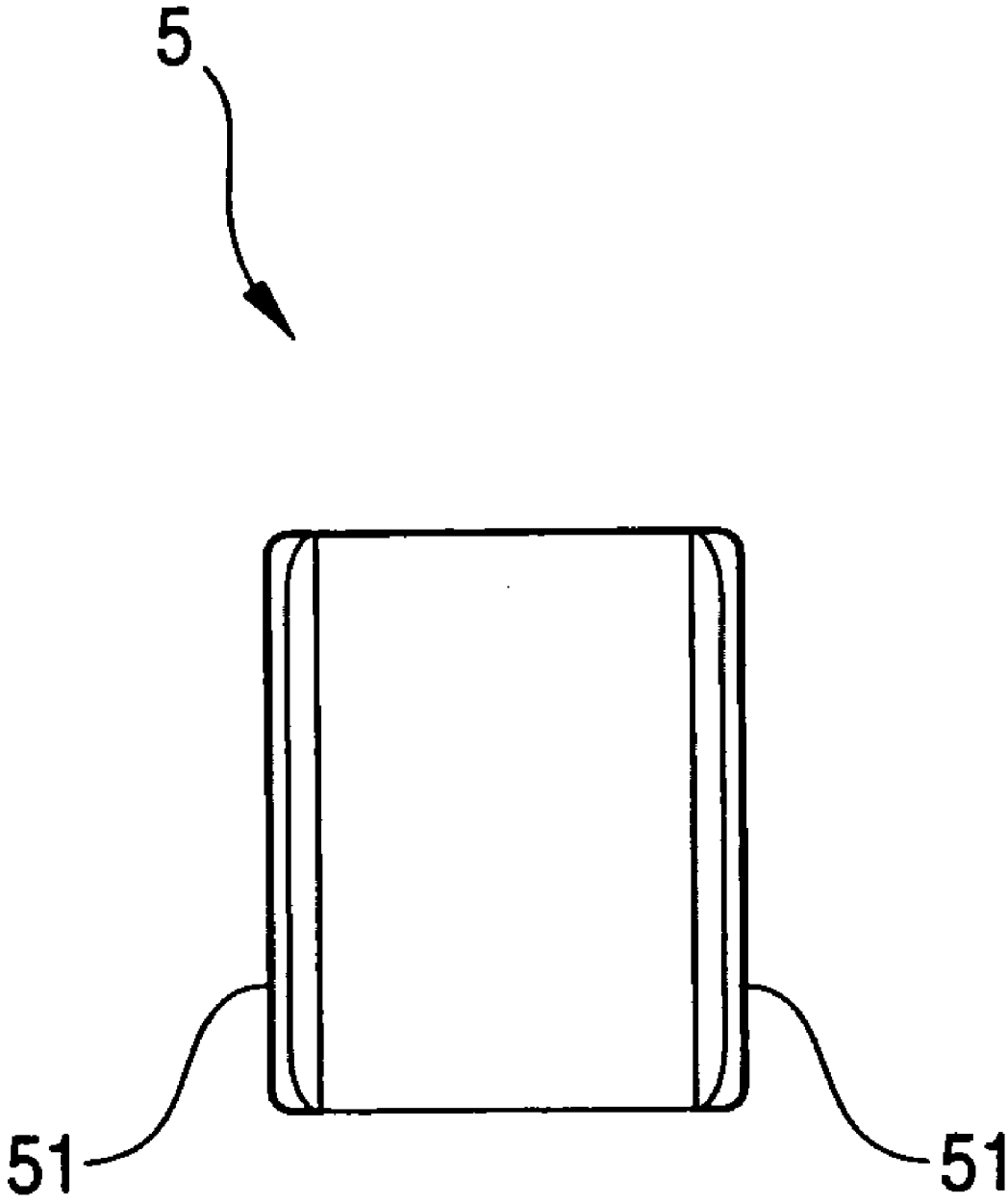
FIG. 9 is a top view of the caulking member.

As described later, a caulking member 5 shown in FIG. 8 and FIG. 9 is to connect the lead wire 62 of the capacitor 6 and a core wire 71 of the shielded electric wire to each other. The member 5 is formed by molding a metallic plate having electric conductivity. As shown in FIG. 8, the caulking member 5 is formed to be U-shaped when being observed from its side and is provided with a pair of caulking pieces 51 faced to each other.

Figure 1A:
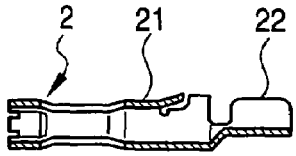
FIG. 1A is a sectional view showing an inner conductor placed in a process for making a shielded electric wire connector according to the invention into an assembly.
Figure 1B:
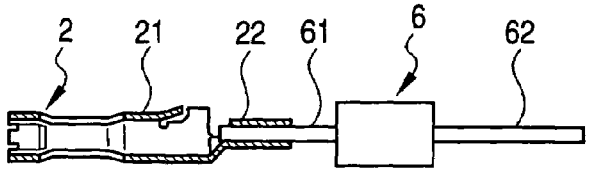
FIG. 1B is a sectional view showing a state where one lead wire of a capacitor is connected to an inner conductor.
Figure 1C:
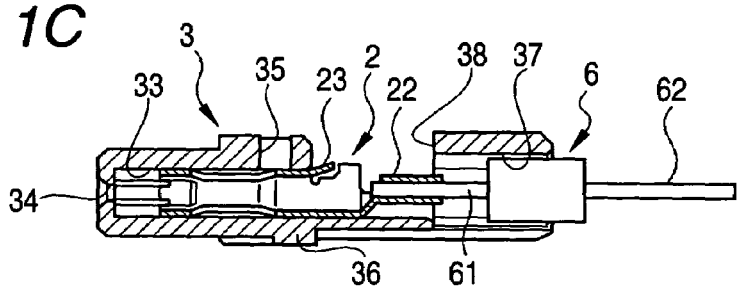
FIG. 1C is a sectional view showing a state where the inner conductor connected to a capacitor is inserted in a housing.
Figure 1D:
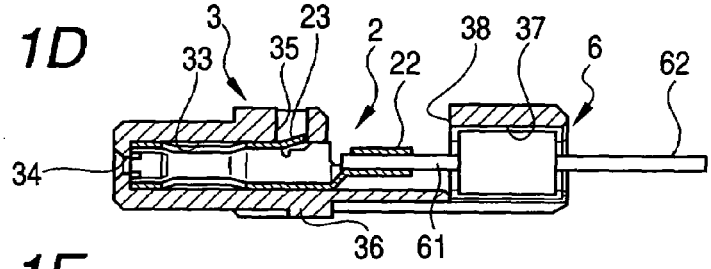
FIG. 1D is a sectional view showing a state where the inner conductor and capacitor are held in the housing.
Figure 1E:
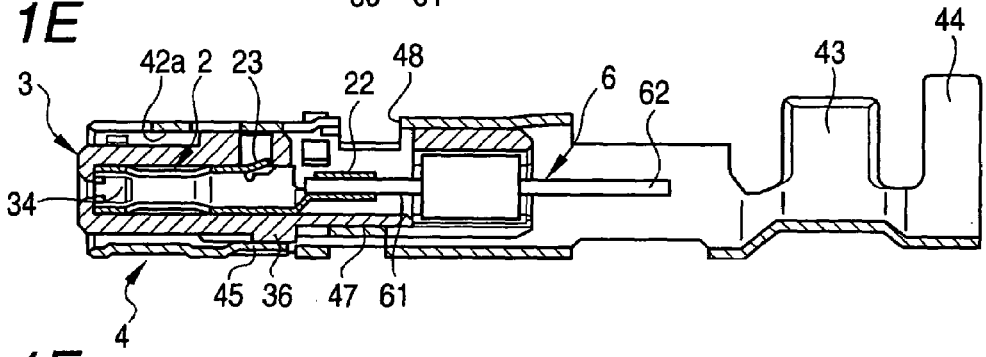
FIG. 1E is a sectional view showing a state where the housing is inserted in an outer conductor.
Figure 1F:
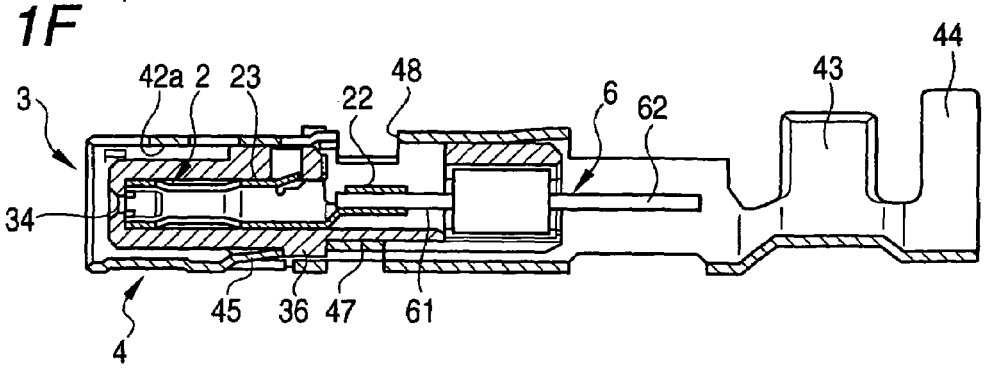
FIG. 1F is a sectional view showing a state where the housing is held in the outer conductor.

Next, on the basis of FIGS. 1A to 1F and FIG. 2A to 2D, a description is given of a method for connecting the shielded electric wire connector 1 according to the present embodiment to a shielded electric wire 7. A lead wire 61 which is one terminal of the capacitor 6 being an electronic element is caulked (pressure-fitted) by the wire barrel 22 of the inner conductor 2 shown in FIG. 1A and is connected (as shown in FIG. 1B). Also, in the embodiment, all the types of capacitors such as a ceramic capacitor, a film capacitor, a paper capacitor, etc., may be used as the capacitor 6.

Next, as shown in FIG. 1C, the inner connector 2 connected to the capacitor 6 is inserted into the rearward of the housing 3. After the engaging piece 23 is brought into contact with the ceiling surface of the inner conductor accommodating hole 33 and is bent downward in line with insertion of the inner conductor 2, the engaging piece 23 is fitted in the engaging hole 35 and is restored to its original shape, wherein the inner conductor 2 is internally incorporated in the inner conductor accommodating hole 33, and is held in a state where the capacitor 6 is accommodated in the element accommodating hole 37 (as shown in FIG. 1D).

Next, as shown in FIG. 1E, the housing 3 which is integrated with the inner conductor 2 and capacitor 6 is inserted into the inner hole 42*a* of the outer conductor 4 from its forward side. After the lock piece 45 is brought into contact with the lock protrusion portion 36 of the housing 3 and is bent downward in line with insertion of the housing 3, the lock piece 45 is disengaged and is restored to its original shape, wherein the lock protrusion portion 36 is not moved any longer in a state where it is placed between the lock piece 45 and the stopper 47, and the housing 3 is held on the outer conductor 4 (as shown in FIG. 1F). At this time, the housing 3 is placed and held between a pair of holding pieces 46 formed on the side of the outer conductor 4 and can be positioned at the middle portion in the shielding portion 42.

By the above-described method, the shielded electric wire connector 1 is made into an assembly in a state where only work for connecting to a shielded electric wire is left over. Since the shielded electric wire connector 1 has the capacitor 6, the electro static capacitance is made adjustable. Also, in the state, a connected state between the inner conductor 6 and the lead wire 6 of the capacitor 6 can be visibly checked through the upper hole 48 formed in the outer conductor 4.

The shielded electric wire 7 shown in FIG. 2A is generally called a coaxial cable. The coaxial cable is such that, after the core wire 71 being a conductor is shielded by an insulative inner sheath 72 and is shielded by a shielding member 73 formed of braided wires having conductivity, the core wire 71 is further shielded by an insulative outer sheath 74. As shown in FIG. 2B, the insulative inner sheath 72, shielding member 73 and insulative outer sheath 74 are striped stepwise at the end portion of the shielded electric wire 7, whereby the core wire 71 and the end portion of the shielding member 73 are exposed.

Thereafter, the shielded electric wire connector 1 assembled by the above-described method is supplied to be connected with the shielded electric wire 7. Herein, the shielded electric wire 7 is disposed with respect to the shielded electric wire connector 1 so that the end portion of the core wire overlaps with the other lead wire 62 of the capacitor 6, the exposed shielding member 73 is positioned on the shield barrel 43 of the outer conductor 4, and further the insulative outer sheath 74 is placed on the cable barrel 44 (as shown in FIG. 2C). At this time, since the position of the shielded electric wire 7 on the outer conductor 7 is determined by position matching between the shield barrel 43 and the shielding member 73, dispersion in the position of the capacitor 6 for the outer conductor 4 and dispersion in the position of the core wire 71 for the shielding member 73 can be absorbed (adjusted) by an overlapping length of the lead wire 62 and the core wire 71.

After that, by pressure-fitting the caulking member 5, the lead wire 62 of capacitor 6 and the core wire 72 are connected to each other, and at the same time, the outer conductor 4 and shielding member 73 are connected to each other by caulking the shield barrel 43 and cable barrel 44. Further, the shielded electric wire 7 is held by the outer conductor 4. Pressure-fitting of the caulking member 5, shield barrel 43 and cable barrel 44 may be simultaneously carried out or may be carried out with time changed. Also, since the upward of the connection portion 41 of the outer conductor 4 is made open, the connected state of the core wire 71 and the lead wire 62 of the capacitor 6 can be visibly checked in this state.

In the embodiment, since such a construction is employed in which the inner conductor 2 connected with one lead wire 61 of the capacitor 6 is inserted and held in the inner conductor accommodating hole 33 of the housing 3, and further the housing 3 is supplied in a state where the housing 3 is inserted and held in the inner hole 42*a* of the outer conductor 4, the shielded electric wire connector 1 can be made into an assembly in a state where only work for connecting the connector 1 to the shielded electric wire 7 is left over. Therefore, connection work can be efficiently carried out, and efficiency of conveying work of components can be improved.

In addition, since the shielded electric wire connector 1 has a capacitor 6, the electrostatic capacitance thereof is made adjustable and the connector 1 has various types of uses. Also, since the inner conductor 2 is configured so as to have a deflection piece which is engaged with the terminal of the mating connector, wearing thereof due to fitting to the terminal of a mating connector can be reduced, wherein the reliability of connection can be improved. Further, since the inner conductor 2 is connected to the other lead wire 61 of the capacitor 6 by caulking (pressure-fitting) the wire barrel 22 of the inner conductor 2, the inner conductor 2 can be firmly connected to the capacitor 6 by a simple method. Still further, since connection of the capacitor 6, inner conductor 2 and shielded electric wire 7 is carried out not by soldering but pressure-fitting, it is possible to achieve a shielded electric wire connector 1 which is friendly to the environment.

(Other Embodiments)

The invention is not limited to the embodiment which has been explained on the basis of the above description and accompanying drawings. For example, the following embodiments are also included in the technical scope of the invention. Furthermore, the invention may be subjected to various modifications in the scope not departing from the spirit of the invention, other than the following descriptions.

(1) If an electronic element connected to the inner conductor is a diode, signals transmitted by the shielded electric wire connector is made rectifiable, wherein the connector will include further more uses.

(2) If one lead wire of an electronic element is connected to the inner conductor by welding, it is possible to further firmly connect the inner conductor with the electronic element in comparison with soldering.

(3) Various methods such as welding, brazing, etc., in addition to pressure-fitting are available for connection of the other lead wire of an electronic element with the core wire of a shielded electric wire.

What is claimed is:

1. A connector for a shielded electric wire comprising:

an inner conductor connectable to one lead wire of an electronic element, the inner conductor having a top side and a bottom side;

a dielectric having an accommodation hole extending through a center of the dielectric and an engaging hole on a top side of the dielectric;

an elastically deformable engaging piece protruding upward from the top side of the inner conductor, the elastically deformable engaging piece engageable with the engaging hole of the dielectric;

an outer conductor having an inner hole; and a shielded electric wire having a shielding member and a core wire connectable to an other lead wire of the electronic element, wherein the accommodation hole of the dielectric holds the inner conductor connected to said one lead wire of the electronic element, wherein the core wire of the shielded electric wire is connected to the other lead wire of the electronic element after the dielectric is inserted and held in the inner hole of the outer conductor, and wherein the shielding member of the shielded electric wire is connected to the outer conductor.

2. The connector for shielded electric wire according to claim 1, wherein the electronic element is a capacitor of which electrostatic capacitance is adjustable.

3. The connector for shielded electric wire according to claim 1, wherein the electronic element is a diode which rectifiably transmits a signal.

4. The connector for shielded electric wire according to claim 1, wherein the one lead wire of the electronic element is connected to the inner conductor by pressure fitting.

5. The connector for shielded electric wire according to claim 1, wherein the inner conductor and the one lead wire of the electronic element are connected to each other by welding.

6. A method of connecting a connector with a shielded electric wire, the connector comprising a dielectric having an accomodation hole extending through a center of the dielectric and an engaging hole on a top side of the dielectric, and an inner conductor connectable to one lead wire, the inner conductor having a top side and a bottom side, wherein an elastically deformable engaging piece protrudes upward from the top side, the elastically deformable engaging piece engageable with the engaging hole of the dielectric, comprising the steps:

inserting the inner conductor into the accommodation hole of the dielectric;

inserting the dielectric in an inner hole of an outer conductor to be held therein;

connecting a shielding member of the shielded electric wire to the outer conductor while a core wire of the shielded electric wire is connected to the other lead wire of an electronic element;

wherein the inner conductor is pushed into the accommodation hole of the dielectric until the elastically deformable engaging piece engages the engaging hole of the dielectric.

* * * * *